US006425136B1

(12) United States Patent
Schlamp et al.

(10) Patent No.: US 6,425,136 B1
(45) Date of Patent: Jul. 30, 2002

(54) LINT REMOVAL GLOVE

(76) Inventors: Lori A. Schlamp; Steven K. Schlamp, both of 114 Privateer Ct., Jupiter, FL (US) 33458

( * ) Notice: Subject to any disclaimer, the term of this patent is extended or adjusted under 35 U.S.C. 154(b) by 0 days.

(21) Appl. No.: 09/840,690

(22) Filed: Apr. 21, 2001

(51) Int. Cl.[7] ..... A41D 19/00
(52) U.S. Cl. ..... 2/159; 2/161.6; 206/278
(58) Field of Search ..... 2/159, 161.6, 167; 206/278, 820, 390; 15/104.002

(56) References Cited

U.S. PATENT DOCUMENTS

| | | | | |
|---|---|---|---|---|
| 3,056,154 | A | * | 10/1962 | Neal |
| 3,191,187 | A | * | 6/1965 | Comer et al. |
| 3,329,548 | A | * | 7/1967 | Blatz |
| 3,384,083 | A | * | 5/1968 | Cozza et al. |
| 3,520,539 | A | | 7/1970 | Haws |
| 3,787,898 | A | | 1/1974 | Walker |
| 4,038,787 | A | | 8/1977 | Bianchi |
| 4,427,726 | A | | 1/1984 | Wolfrum |
| 4,567,065 | A | * | 1/1986 | Schneiderman |
| 4,773,532 | A | * | 9/1988 | Stephenson |
| 4,820,558 | A | * | 4/1989 | Sundberg |
| 4,916,757 | A | * | 4/1990 | Berlin et al. |
| 4,942,992 | A | * | 7/1990 | Fischer et al. |
| 5,553,344 | A | | 9/1996 | Rosenkrantz |
| 5,894,623 | A | * | 4/1999 | Thill |
| 5,911,321 | A | * | 6/1999 | Brinkmann |
| 6,024,970 | A | | 2/2000 | Woodard |
| 6,049,022 | A | | 4/2000 | Tseng et al. |

FOREIGN PATENT DOCUMENTS

| | | | |
|---|---|---|---|
| GB | 2164540 | * | 3/1986 |
| JP | 5-247705 | * | 9/1993 |
| WO | 8900385 | * | 1/1989 |

* cited by examiner

*Primary Examiner*—Rodney M. Lindsey
(74) *Attorney, Agent, or Firm*—Gold & Rizvi, P.A.; Glenn E. Gold; H. John Rizvi

(57) ABSTRACT

A disposable lint glove (10) is constructed from a multi-layer sheet (30) which act as an integral glove packaging means. The glove has front and rear layers (12, 14) of plastic sheeting each having the form of a human hand and heat sealed about their respective peripheries to form a unitary glove having a hand-receiving opening (22). An adhesive coating (28) is disposed upon an outer surface (26) of the glove.

10 Claims, 4 Drawing Sheets

LINT REMOVAL GLOVE

FIELD OF THE INVENTION

This invention relates generally to gloves for removing lint, hair, and other fibrous and particulate matter and materials from a selected surface, and, more particularly, to disposable lint gloves used to remove hair and other unwanted fibers and particulate matter from surfaces such as, but not limited to, clothing, furniture, bedding, car upholstery, and the like, and the methods of using the same.

BACKGROUND OF THE INVENTION

Materials and devices for removing lint from various surfaces have been developed. As used herein, the term "lint" means fibers from both natural and/or synthetic sources, including hair from any animal, and any natural and/or synthetic particles or particulate matter. Typically, lint removal materials are comprised of a paper-type support substrate having an adhesive layer provided thereon, such as a masking tape.

Commonly, lint removal materials are carried in one form or another on a hand held device which is manipulated to effect removal of the lint. For example, roller type devices such as the device taught in U.S. Pat. No. 4,427,726, incorporate a roll of adhesive tape supported by a handle member and adapted for being rolled against a lint containing surface. Still other devices, such as the lint pick-up device taught in U.S. Pat. No. 5,553,344, incorporate individual adhesive coated planar sheets attached to a support platform at the end of an elongated handle for being repeatedly forced against a lint containing surface. These and other such adhesive material carrying devices have a number of drawbacks and limitations. For example, they can be difficult and unwieldy to handle, often requiring the user to control a separate apparatus upon which a supply of adhesive tape must be continually adjusted and maintained. Furthermore, such devices are often too large and cumbersome to be comfortably maintained on one's person until needed.

Lint removal mitts having adhesive thereon and configured for receiving some or all of a user's hand also have disadvantages. Some such devices, such as that taught in U.S. Pat. No. 3,056,154, are difficult to control and can inadvertently fall off during use. U.S. Pat. No. 6,024,970 teaches such a device which includes a wrist retention means for lessening the propensity of the mitt to fall off during use. However, the mitt taught in the '970 patent has a number of inherent disadvantages and limitations. For example, the necessity for a special wrist retention means requires the wearer to carefully fold the mitt along specific fold lines after placing a hand in the mitt, in order to secure the lower end of the mitt about the user's wrist so that the lint mitt will not easily fall off or slip off of the user's hand during use. Furthermore, the lint mitt taught in the '970 patent includes a single finger retaining area which limits the precision and control with which a user can contact a small, hard-to-reach area. Additionally, the '970 patent does not teach a construction or method enabling a plurality of individual-packaged lint mitts to be compactly and discreetly carried on ones person, nor does it teach a construction or method enabling a plurality of individual mitts to be dispensed from a common source.

SUMMARY OF THE INVENTION

It is an object of the present invention to provide a disposable lint removing glove having the form of a human hand, wherein the glove has at least one tacky surface and is shaped and sized for being snugly retained upon the hand of a wearer without easily falling off or slipping off during use.

It is another object of the present invention to provide a lint removing glove having a protective layer covering the tacky surface, wherein the protective layer maintains the integrity of the tacky surface until peeled away by the wearer.

It is a further object of the present invention to provide a lint removing glove constructed from a multi-layer planar sheet, wherein the multi-layer construction incorporates integral packaging means for protecting the glove in a compact form.

It is yet a further object of the present invention to provide a plurality of lint removing gloves constructed from and maintained along a contiguous multi-layer planar sheet carried on a roller in a compact rolled-up form, wherein individual gloves are separated along the sheet by a plurality of spaced apart perforated lines.

These and other objects are achieved with the lint removing glove of the present invention which in one aspect of the invention comprises: front and back layers of plastic sheeting each having the form of a human hand and heat sealed about their peripheries to form a unitary glove having a hand-receiving opening defining an inner retaining space including individual palm, thumb and finger-receiving spaces; a tacky coating disposed upon and chemically attached to an outer facing surface of the front layer; and a removable adhesive protection layer overlying the adhesive coating, wherein upon peeling away the protective layer, the adhesive coating is left substantially intact on the outer surface of the front layer of the glove.

In another aspect of the invention, a combination disposable lint removal glove and packaging construction is provided, comprising: a base substrate having upper and lower surfaces; a front layer of plastic sheeting having a lower surface; an adhesive coating disposed upon and chemically attached to the lower surface of the front layer of plastic sheeting; and a back layer of plastic sheeting disposed above the first layer of plastic sheeting. The front and back layers of plastic sheeting are selectively heat sealed to each other to form a sealed peripheral glove portion having the form of a human hand, with the front and back layers left unattached along a bottom end of the hand form to fashion a hand-receiving opening. A perforated hand form is provided through the plastic sheeting layers and the adhesive slightly exterior of the peripheral seal to enable the glove to be isolated from the underlying base substrate with the adhesive coating remaining intact on the front layer lower surface.

In a further aspect of the present invention, the lint glove packages are provided in the form of a contiguous roll of sheet-type packages separated by perforation lines. Preferably, the contiguous roll of packages is maintained upon a roller.

In still another aspect of the present invention, individual packages are provided in which the base substrate is inwardly folded to form a compact package in which only the lower surface of the base substrate remains exposed.

DETAILED DESCRIPTION OF THE PREFERRED EMBODIMENTS

In use, the disposable lint gloves of the present invention can be constructed having either a left- or right-handed orientation for being worn on the respective left or right hand of a user. However, for the purpose of simplicity, the ensuing description and corresponding drawing figures refer specifically to a right-handed glove; it being understood that the orientation of the glove is not intended to be limiting.

Figure 1:
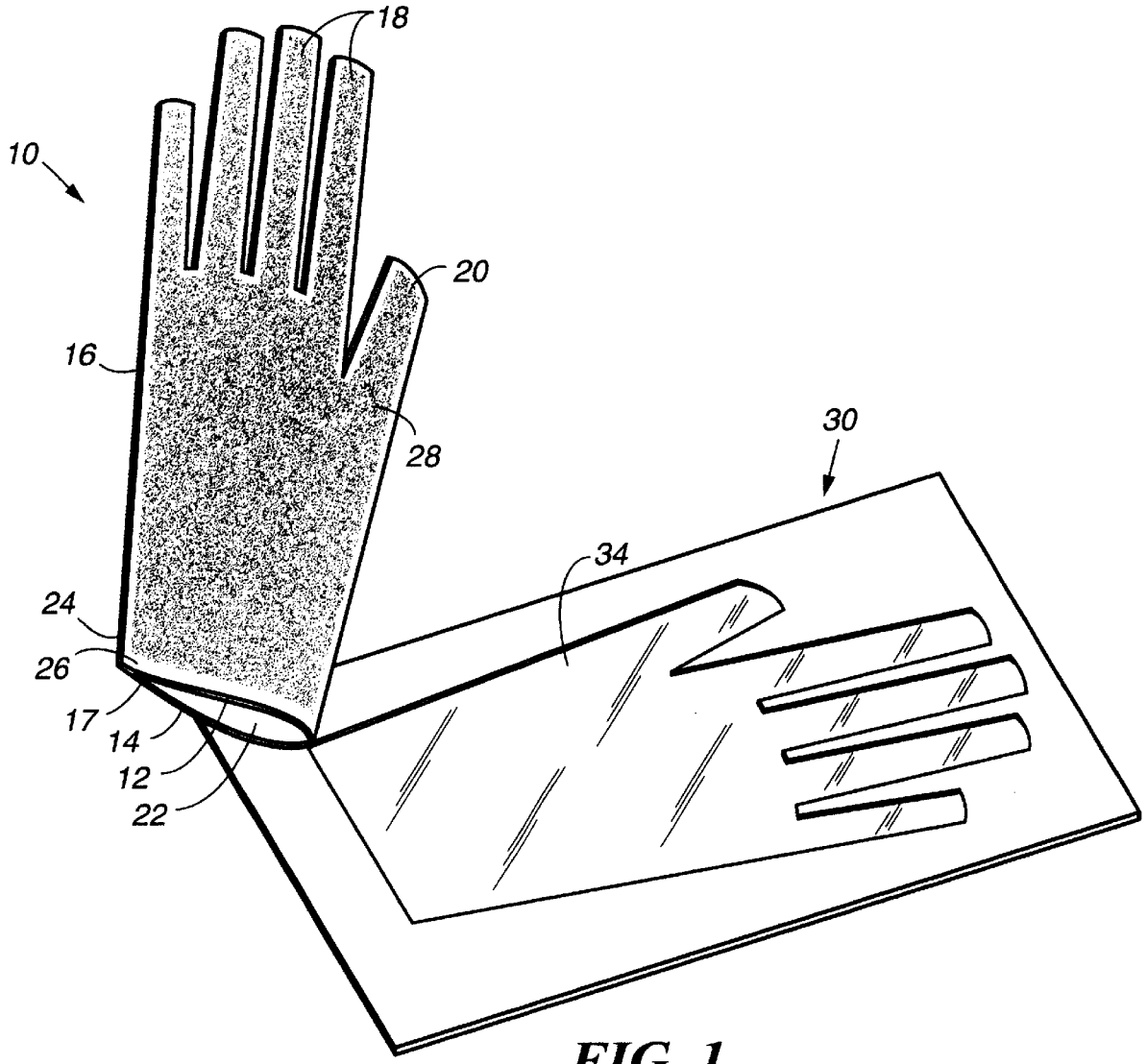
FIG. 1 is a perspective view of a disposable lint glove and lint glove packaging construction in accordance with the present invention.

Referring now to FIG. 1, in one aspect of the invention a disposable lint glove, designated generally by the reference numeral 10, is removable from a multi-layer sheet packaging, designated generally by the reference numeral 30, just prior to use. A front plastic layer 12 and a rear plastic layer 14, each having the form of a human hand, are selectively attached to form a peripheral glove seal 16. At a bottom end 17 of the glove 10, the individual plastic layers 12, 14, or plies, are left unsealed such that a hand-receiving opening 22 is formed upon separating the glove 10 from the multi-layer sheet 30. Preferably, the aforementioned selective attachment of plastic layers 12 and 14 is achieved using a conventional heat sealing process, as is well known in the art. Alternatively, the plastic layers 12, 14 can be connected using an adhesive or by any other method or means known in the art. Both the front and rear plastic sheets 12 and 14, respectively, have a thickness in a range from about 0.1 mils to about 20 mils, and preferably in the range a range from about 0.5 mils to about 15 mils. The front and rear plastic sheets can be constructed from any plastic sheeting known in the art and adaptable for use with the present invention. Preferably, the front and rear plastic sheets are constructed from polyethylene.

An adhesive coating 28, or tacky layer, is disposed on at least a portion of outer-facing surface 26 of front plastic layer 12. Preferably, the adhesive coating 28 is applied to substantially the entire outer surface 26. The adhesive can be a pressure sensitive adhesive, or, alternatively, may comprise any other adhesive that operates to adhere and hold lint thereto, and operates as described herein. Prior to separating glove 10 from package 30, tacky layer 28 adheres to underlying multi-layer sheet surface 34. However, the tacky layer 28 has greater adhesion to the glove surface 26, remaining substantially attached thereto upon separating the glove from the multi-layer sheet package. As previously mentioned, the lint glove 10 has the form of a human hand and includes separate finger receiving portions 18 and a thumb receiving portion 20.

Figure 2:
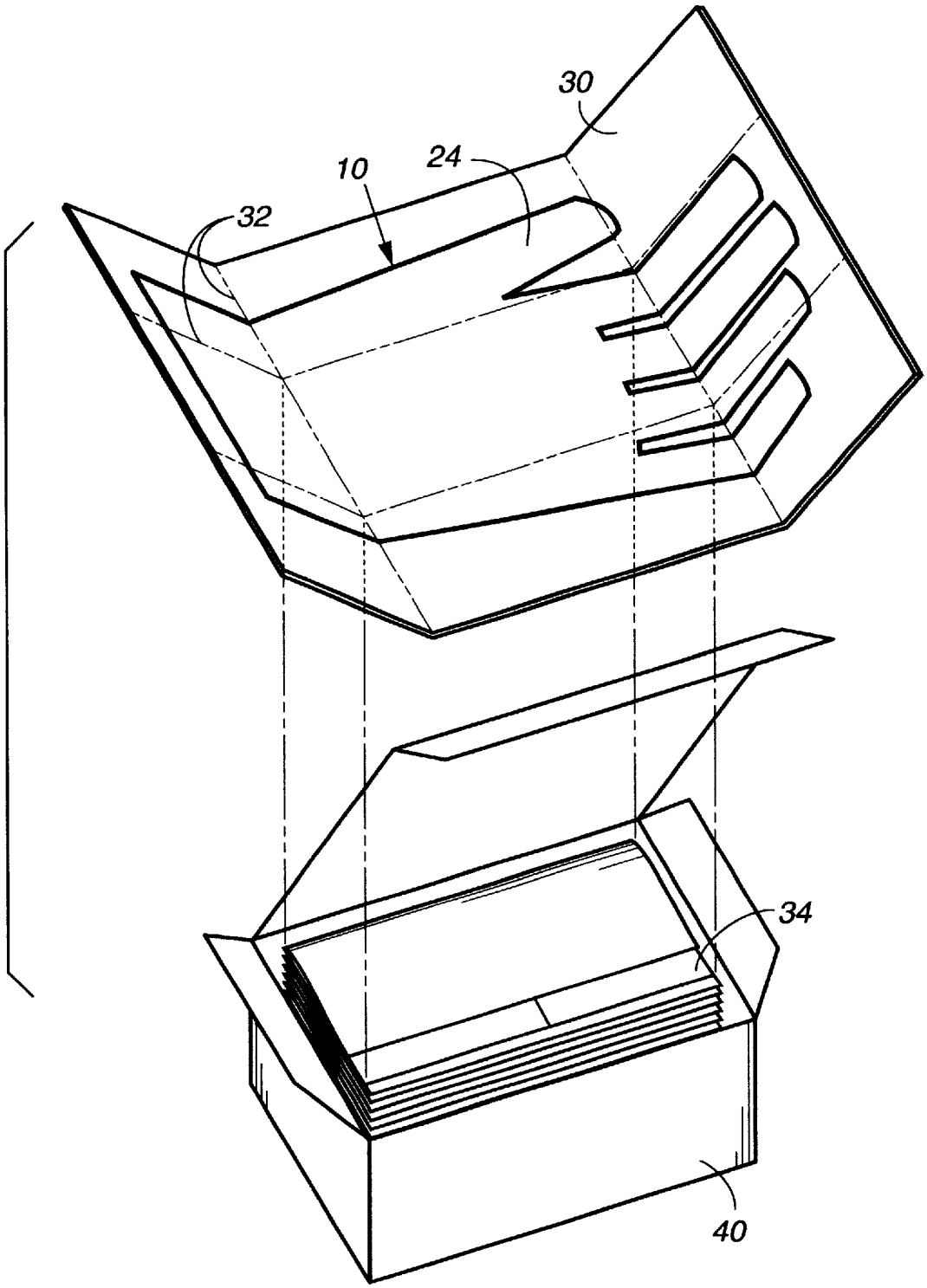
FIG. 2 is a perspective view of a compact disposable lint glove packaging construction in accordance with a further aspect of the present invention.

Referring now to FIG. 2, in another aspect of the invention, the packaging 30 is provided having a plurality of fold lines 32 for enabling the multi-layer sheet 30, including the integral glove portion 10, to be folded inwardly to create a single compact glove package 34 completely enveloping glove 10. The compactly packaged gloves can be carried individually, or, alternatively, a plurality of packaged gloves 34 can be conveniently carried within a container 40. Although a box type container is depicted in FIG. 2, it is to be understood that other available types of packaging can be used. For example, the folded glove packages 34 have a size and shape conducive to being packaged, for individual dispensing, in a plastic package of the type commonly used for pocket-sized facial tissues.

Figure 3:
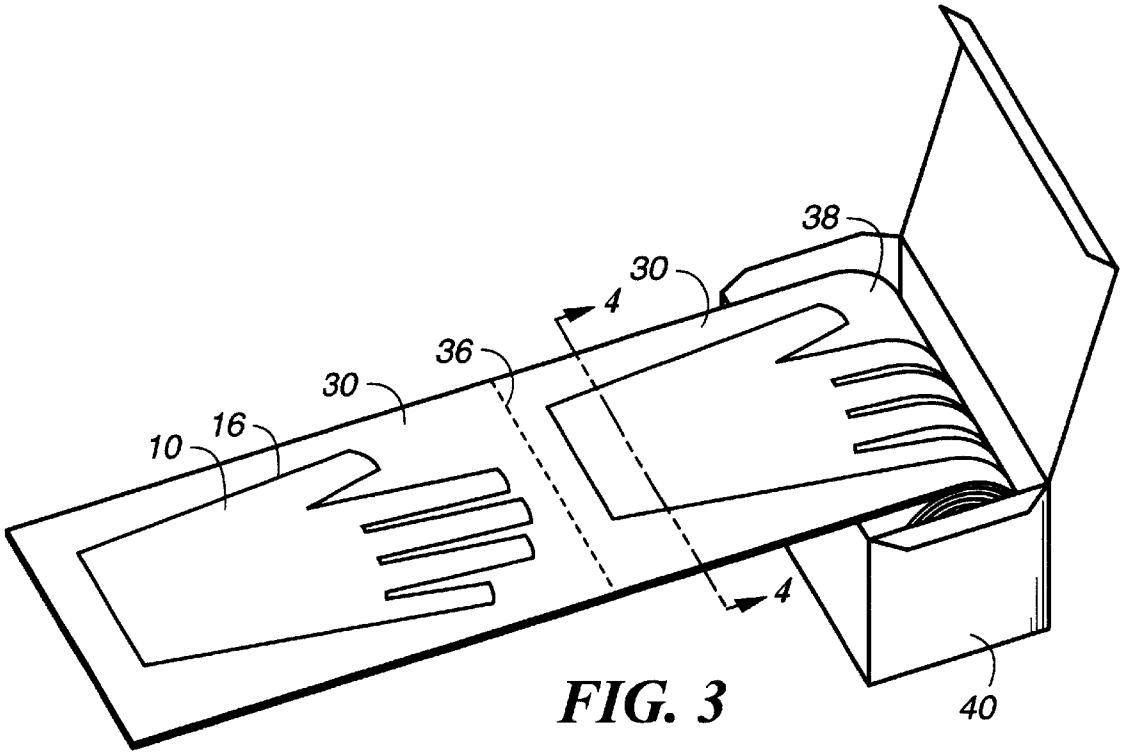
FIG. 3 is a perspective view of a compact rolled-up package of lint gloves in accordance with a further aspect of the invention.

Referring now to FIG. 3, in another aspect of the invention, a plurality of multi-layer sheets 30 incorporating glove portions 10 are provided in the form of a roll 38. More particularly, the roll 38 comprises a plurality of the multi-layer sheet packages 30 attached to one another, but separable along perforate lines 36. The roll 38 of sheet-style packages 30 is preferably carried on a roller (not shown) such as a the cardboard type roller conventionally used to carry paper towels and the like. Roll 38 can be maintained within a container 40, or, alternatively, the roll 38 can be carried on any conventional roll-receiving dispenser apparatus adaptable for use with the present invention.

Figure 4:
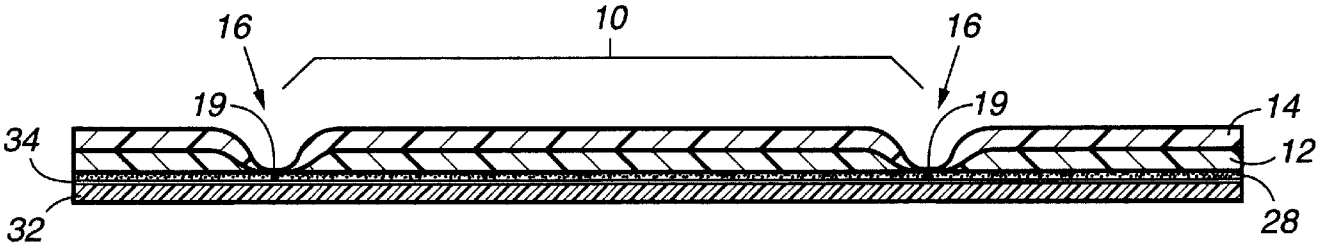
FIG. 4 is a cross-sectional view taken along section 4—4 of FIG. 3.

Referring briefly to FIG. 4, a cross-sectional view along cut line 4—4 of FIG. 3 is provided to more clearly illustrate the multi-layer sheet 30 construction of the present invention. Back plastic layer 14 is provided disposed atop front plastic layer 12. Adhesive coating layer 28 is provided interposed between front plastic layer 12 and upper surface layer 34 of base substrate 32. Preferably, base substrate 32 comprises a paper material which can function as an adhesive coating protection after the glove portion 10 is separated from the sheet 30. A heat sealing means is employed to create sealed glove periphery 16. Perforations 19 are provided running through the heat seal (as shown in FIG. 4), or exterior thereto, and extending at least through adhesive layer 28. Methods and means for performing combined heat sealing and perforation operations are well known in the art.

Figure 5:
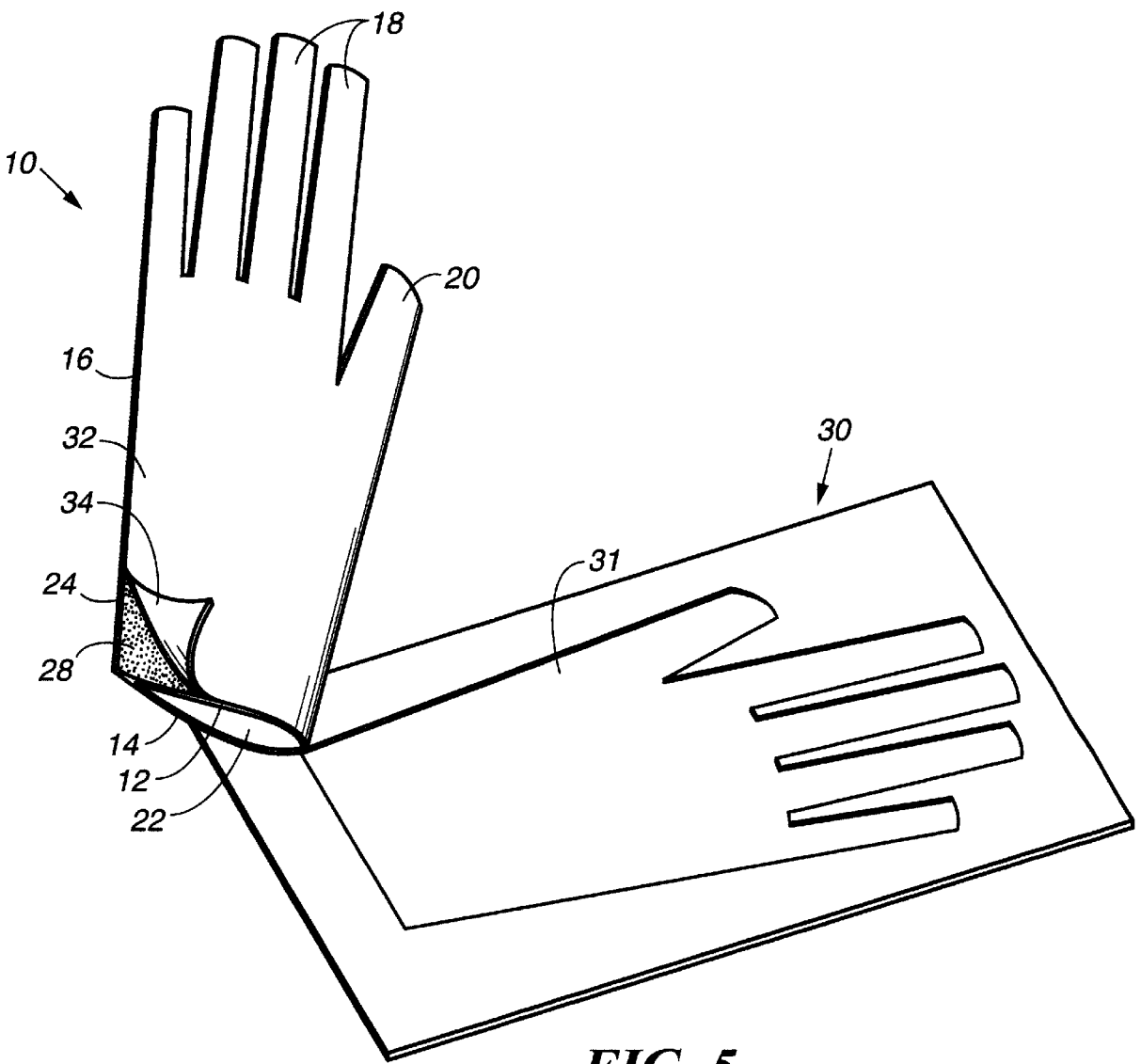
FIG. 5 is a perspective view of a disposable lint glove in accordance with a further aspect of the invention.

Referring now to FIG. 5, in a further aspect of the present invention, the aforementioned perforations made proximate to the glove seal are provided extending completely through the base substrate 32. In this manner, the glove 10 can be manually separated from multi-layer sheet 10, while maintaining surface 34 of layer 32 attached to the adhesive coating 28. The protective layer 34 can be subsequently peeled away when the glove is to be used for lint removal. Alternatively, in lieu of perforations, the glove can be completely excised after heat sealing, via a die cutting or other known means. A plurality of separated gloves 10 can be folded and packaged for individual dispensing, as previously described herein.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims. For example, although adhesive coating 28 is only illustrated disposed on front layer 12, it will be apparent to those skilled in the art that adhesive coating 28 can be provided anywhere on the outer surface of the glove. More specifically, the adhesive coating can be applied to the entire outer surface or portions thereof, and on either the front layer, the back layer, or both. Furthermore, where the adhesive coating coverage is extended to the back layer 14, a second adhesive coating protection layer, such as layer 32, could be incorporated.

We claim:

1. A disposable lint removal glove and packaging construction, comprising:

a base substrate having upper and lower surfaces;

a front layer of plastic sheeting having upper and lower surfaces;

an adhesive layer interposed between and chemically attached to the lower surface of said front layer of plastic sheeting and the upper surface of said base substrate, said adhesive layer having greater adhesion to the lower surface of said front layer of plastic sheeting than to the upper surface of said base substrate; and a back layer of plastic sheeting disposed above said front layer of plastic sheeting;

said front and back layers of plastic sheeting selectively attached to each other by a seal having the form of a human hand and defining a glove portion, the front and back layers left unattached along a bottom end of said hand form to define a hand-receiving opening;

said front and back layers of plastic sheeting each having aligned perforated hand forms provided therethrough for facilitating the excising of said glove portion from said front and back plastic sheeting;

said base substrate having at least one fold line positioned for enabling said base substrate to be inwardly folded in such a manner that said glove portion is completely enclosed therein.

2. A disposable lint removal glove and packaging construction as recited in claim 1, wherein said seal further comprises a heat seal.

3. A disposable lint removal glove and packaging construction as recited in claim 1, wherein said base substrate is inwardly folded along said at least one fold line in such a manner that said glove is completely enveloped by said base substrate to form a compact package in which only the lower surface of said base substrate remains exposed.

4. A disposable lint removal glove and packaging construction as recited in claim 1, wherein the aligned perforated hand forms in said front and back layers of plastic sheeting extend medially along said sealed peripheral glove portion.

5. A disposable lint removal glove and packaging construction as recited in claim 1, wherein said perforated hand forms extend adjacent to and just beyond said seal.

6. A method for constructing a disposable lint removal glove having an integral compact glove packaging, comprising the steps of:

providing a front layer of plastic sheeting, a back layer of plastic sheeting, and a base substrate having integral fold lines;

securing a lower surface of said front layer of plastic sheeting to an upper surface of said base substrate via an adhesive layer;

positioning said back layer of plastic sheeting over said front layer of plastic sheeting;

heat sealing said front and back layers of plastic sheeting to form a sealed peripheral glove portion in the shape of a human hand with the front and back layers left unattached along a bottom end thereof to form a hand receiving opening;

selectively perforating said front and back layers of plastic sheeting to enable said glove portion to be excised therefrom; and inwardly folding said base substrate along the integral fold lines such that said base substrate forms a compact glove outer packaging.

7. A method as recited in claim 6, wherein the step of securing further comprises introducing a layer of chemical adhesive upon the lower surface of said front layer of plastic sheeting.

8. A method as recited in claim 6, wherein the step of securing further comprises introducing a layer of chemical adhesive upon the upper surface of said base substrate.

9. A method as recited in claim 6, wherein the step of selectively perforating further comprises selectively perforating said front and back layers of plastic sheeting along the peripheral seal of said glove portion.

10. A method as recited in claim 6, wherein the step of selectively perforating further comprises selectively perforating said front and back layers of plastic sheeting slightly outside of the peripheral seal of said glove portion.

* * * * *